United States Patent [19]

Göransson

[11] 4,040,212

[45] Aug. 9, 1977

[54] LATTICED WIRE STRUCTURE WITH A SOUND-ABSORBING MATERIAL

[75] Inventor: Per Staffan Göransson, Falkenberg, Sweden

[73] Assignee: Kommanditbolaget Pemac Invention AB & Co., Sweden

[21] Appl. No.: 561,715

[22] Filed: Mar. 25, 1975

[51] Int. Cl.[2] ..... E04B 1/82

[52] U.S. Cl. ..... 52/145; 181/33 G

[58] Field of Search ..... 52/144, 145, 125, 83, 52/406, 404, 405, 407; 181/30, 33 G

[56] References Cited

U.S. PATENT DOCUMENTS

| | | | |
|---|---|---|---|
| 183,617 | 10/1878 | Ackerman | 206/83.5 |
| 1,076,240 | 10/1913 | Schaffenhauer | 52/125 |
| 1,397,301 | 11/1921 | Solan | 181/33 G |
| 1,974,519 | 9/1934 | Steffens | 181/33 G |
| 2,160,638 | 5/1939 | Bedell | 181/30 |
| 2,355,608 | 4/1944 | Stieger | 52/145 |
| 2,460,848 | 2/1949 | Rover | 52/145 |
| 2,728,519 | 12/1955 | McCarty | 220/19 |
| 2,730,942 | 1/1956 | Peterson | 52/144 |
| 2,971,643 | 2/1961 | Farley | 206/83.5 |
| 3,418,766 | 12/1968 | Jackson | 52/83 |
| 3,421,273 | 1/1969 | Eckel | 52/145 |
| 3,748,799 | 7/1973 | Tough | 52/145 |
| 3,874,547 | 4/1975 | Howard | 220/19 |

FOREIGN PATENT DOCUMENTS

| | | | |
|---|---|---|---|
| 691,358 | 4/1940 | Germany | 52/404 |
| 821,541 | 9/1951 | Germany | 52/404 |
| 73,653 | 11/1953 | Netherlands | 52/404 |
| 6,802,424 | 8/1968 | Netherlands | 52/406 |
| 482,809 | 4/1938 | United Kingdom | 181/33 G |

*Primary Examiner*—Price C. Faw, Jr.
*Assistant Examiner*—Henry Raduazo
*Attorney, Agent, or Firm*—Beveridge, DeGrandi, Kline & Lunsford

[57] ABSTRACT

A sound rectangular parallelepiped structure having 12 edges and being comprised of a wire lattice having sound absorbing material housed therein, said lattice having longitudinal wires and transverse wires which cross over each other at a plurality of locations, the longitudinal and transverse wires being fixedly interconnected to each other at at least a majority of said plurality of locations causing the structure to be inherently stable, a wire being located at each of said edges of the structure and the spacing between the wires in at least one direction of said lattice being the same as the thickness of the structure.

4 Claims, 36 Drawing Figures

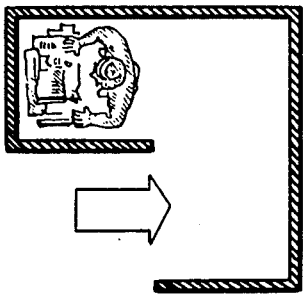
FIG. 24
FIG. 23
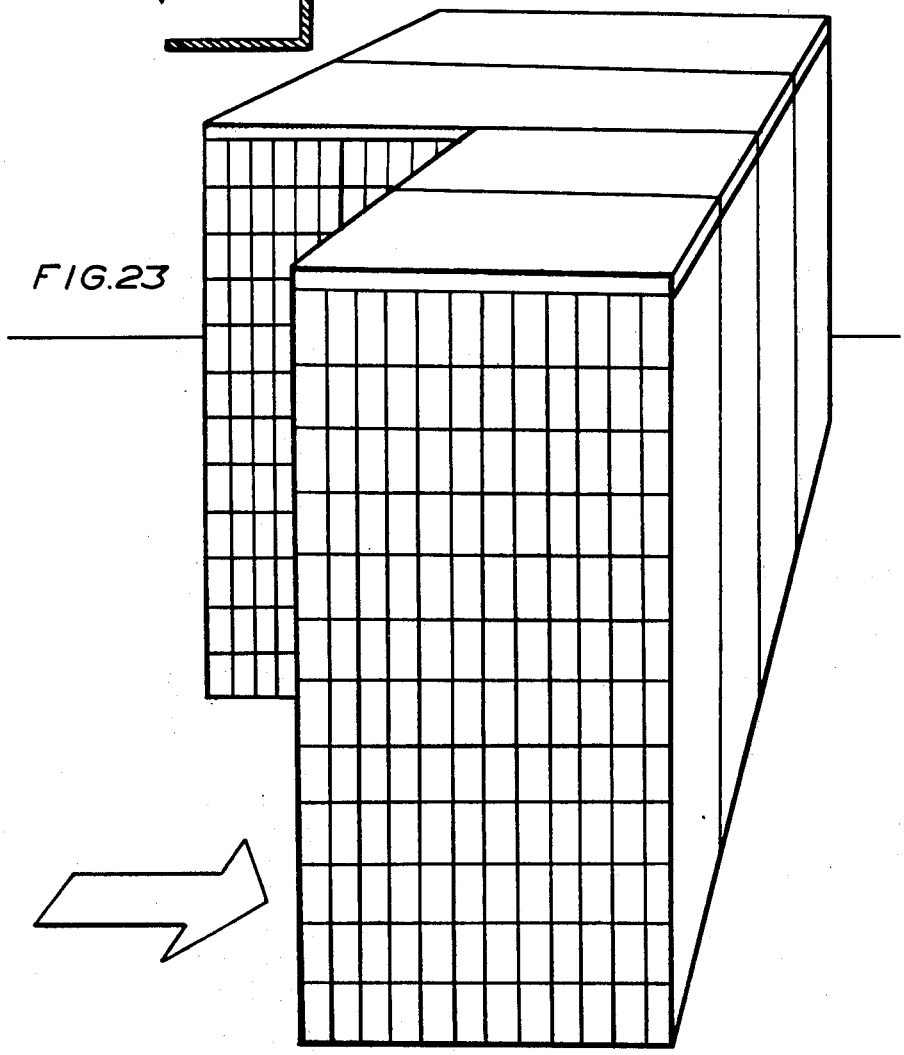

LATTICED WIRE STRUCTURE WITH A SOUND-ABSORBING MATERIAL

The present invention relates to an improved lattice wire structure.

Great requirements are placed on the working environment of different working sites. The problems concerning light and air have been solved in relatively simple and conventional ways. The remaining problem concerning different types of noise has not yet been solved in a generally satisfactory manner. In many noise-afflicted environments the only available solution has been the use of direct ear protectors in the form of ear-muffs supported on a band and provided with sound-damping material. This solution using direct ear protectors has often been resorted to for economic reasons. These direct ear protectors entail many disadvantages primarily for the wearer but also for the wearer's surroundings, since these direct ear protectors also exclude noise or sound which the wearer may wish to be able to hear.

Recently, different types of sound baffles have come into use but these prior art constructions are extremely complicated and consequently incur high costs. Because of the high price level, the use of these constructions has been restricted to office environments etc., while personnel in workshops and at noisy machines are obliged to use the earlier mentioned direct ear protectors.

The object of the present invention is to provide a sound-absorbing structure of such a simple design that the costs can be kept at a level which permits use of the structure according to the invention in more noise-afflicted environments than is possible with the previously known apparatuses or baffles.

This object is achieved according to the present invention in that the wires of the structure are fixedly interconnected at at least the majority of the points of intersection of the wires in order that the wire structure be inherently stable.

Embodiments of the present invention will be described in greater detail hereinbelow and with reference to the enclosed drawings in which:

FIG. 23 is a perspective view of a machine booth which has been built from structures according to the present invention;

FIG. 24 is a horizontal section through the booth of FIG. 23;

Figure 1:
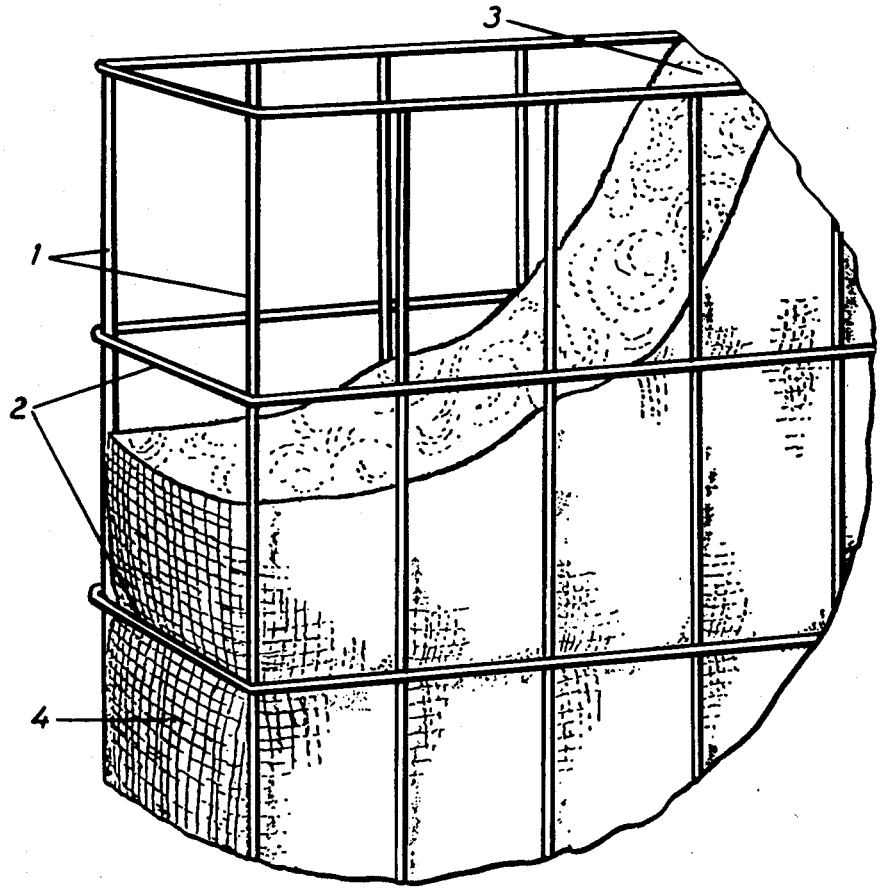
FIG. 1 is a partial perspective view of a structure according to the present invention, certain parts having been broken away for purposes of clarity.

As is apparent from FIG. 1, a structure according to the present invention comprises a support structure which is built from a number of longitudinal wires 1 and a number of transverse wires 2. The wires 1 and 2 are joined together at their points of intersection by, for example, welding. In the embodiment shown in FIG. 1, the wires 1 and 2 form a latticed envelope for a sound-absorbing material 3 which can be of any suitable sound-absorbing type but is preferably manufactured by Gullfiber. The material 3 is preferably disposed in sheet form fitting into the envelope formed by the wires 1 and 2. For an optimum result, the material 3 should be slightly more compressed than are normal insulation sheets. The sheets in the lattice can be provided with a solid outer surface or can be wrapped in an appropriate material 4 which in FIG. 1 is a suitable glass-fibre fabric.

In certain cases it can be advisable to have the glass-fibre fabric on the outside of the entire structure, in which case the envelope formed by the wires 1 and 2 is also enclosed by the fabric 4. It is obvious that any type of suitable material can be used for the coating or wrapping of the sheets in the envelope or of the entire structure.

The distance between the wires 1 is the same throughout the whole of the envelope, as is the distance between the wires 2. Because the distance between the wires 1 is the same throughout the entire envelope, the thickness of the structure will be the same as the spacing of the longitudinal wires 1 at any point throughout the sides of the structure.

A structure according to the present invention can naturally be manufactured in any conventional manner whatsoever. One method is to manufacture a network of wires 1 and 2 which are welded together at each point of intersection, the network being then bent about the sheets of the sound-absorbing material and the ends of a network being welded together.

Figure 2:
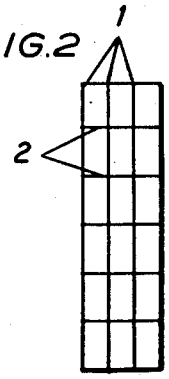
FIGS. 2–7 are views of structures with different modular dimensions.
Figure 3:
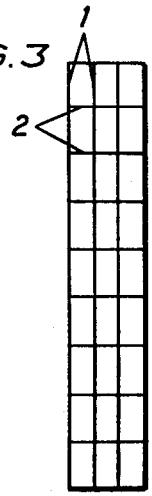
Figure 4:
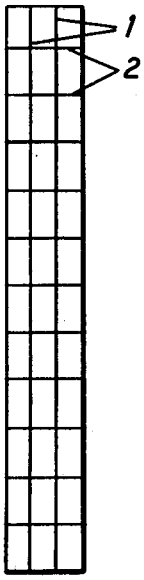
Figure 5:
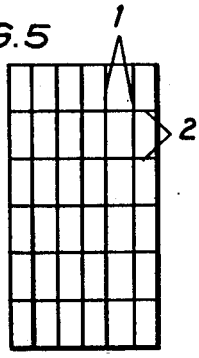
Figure 6:
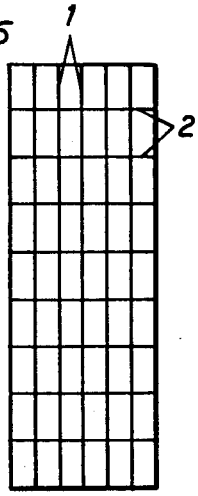
Figure 7:
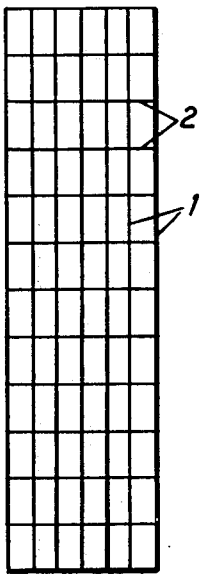

FIGS. 2–7 are side elevations of the structure according to the present invention with different modular dimensions. The structureshown in FIG. 2 is 1200 mm high, while the structure shown in FIG. 3 is 1800 mm high and the structure shown in FIG. 4 is 2400 mm high. The modules in FIGS. 5, 6 and 7 are of the same height as the modules in FIGS. 2, 3 and 4, respectively. In the present example, the distance between the wires 1 in the module shown in FIGS. 2–7 is 100 mm, which entails that the thickness of the structures shown in FIGS. 2–7 is 100 mm. The distance between the transverse wires 2 is 300 mm in the modules shown in FIGS. 2–7.

Figure 8:
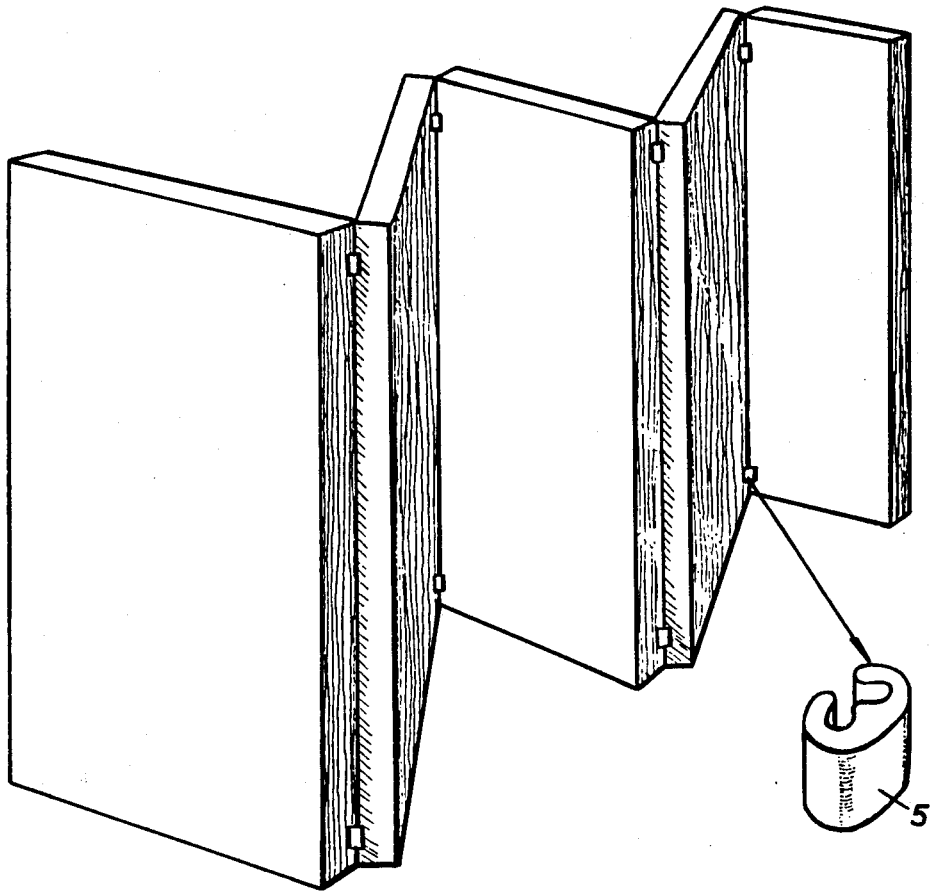
FIG. 8 is a perspective view of a number of structures illustrating their application.
Figure 13:
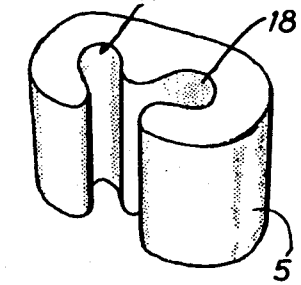
FIG. 13 is a perspective view of a clamp included in FIGS. 8 and 9.

FIG. 8 shows a number of structures according to, for example, FIG. 6, which are placed in zig-zag formation and joined together by means of a clamp 5 of plastics, rubber or some other similar material, shown in more detail in FIG. 13.

Figure 9:
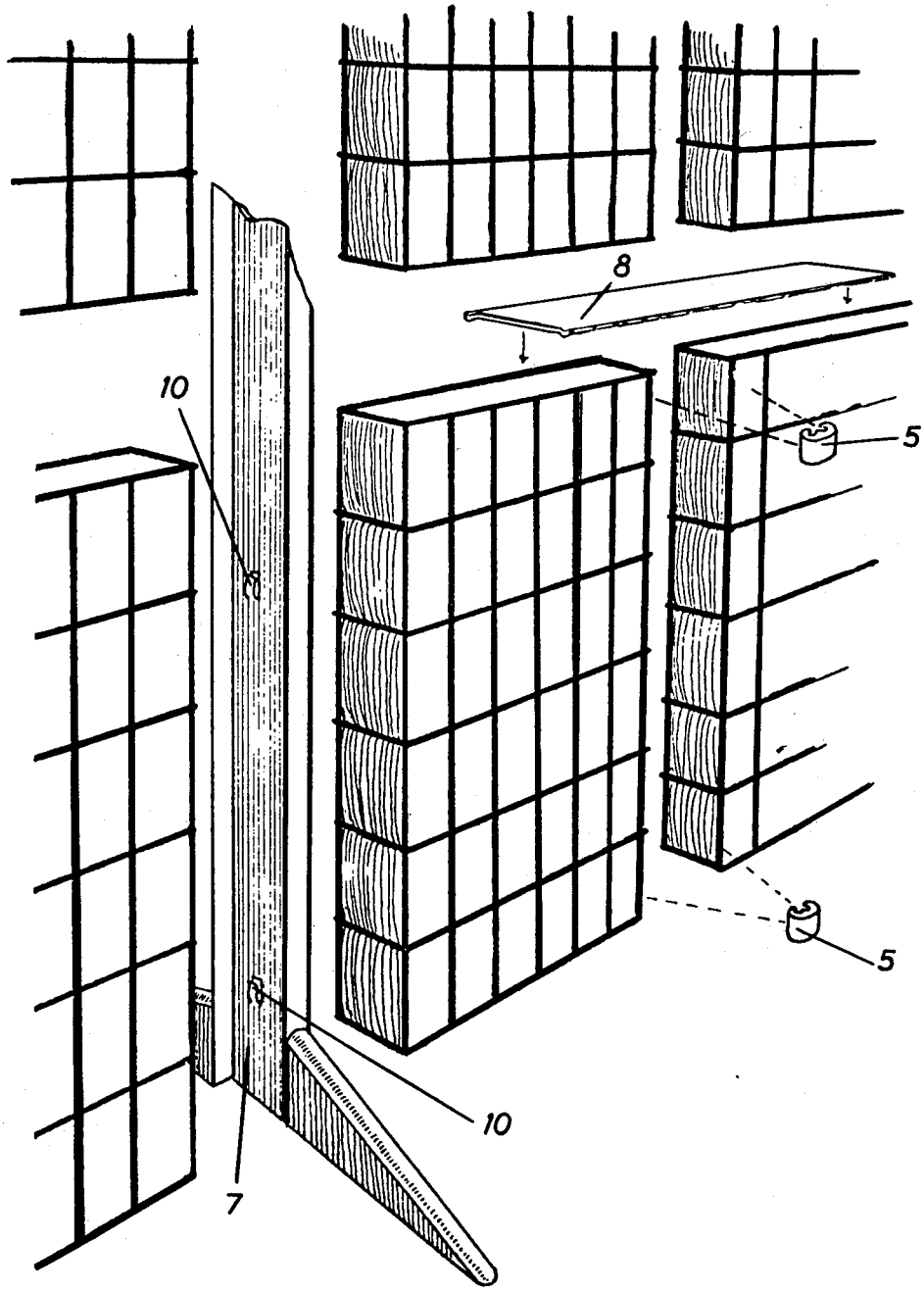
FIG. 9 is a perspective view of structures with different fittings for the assembly of structures such as walls.
Figure 10:
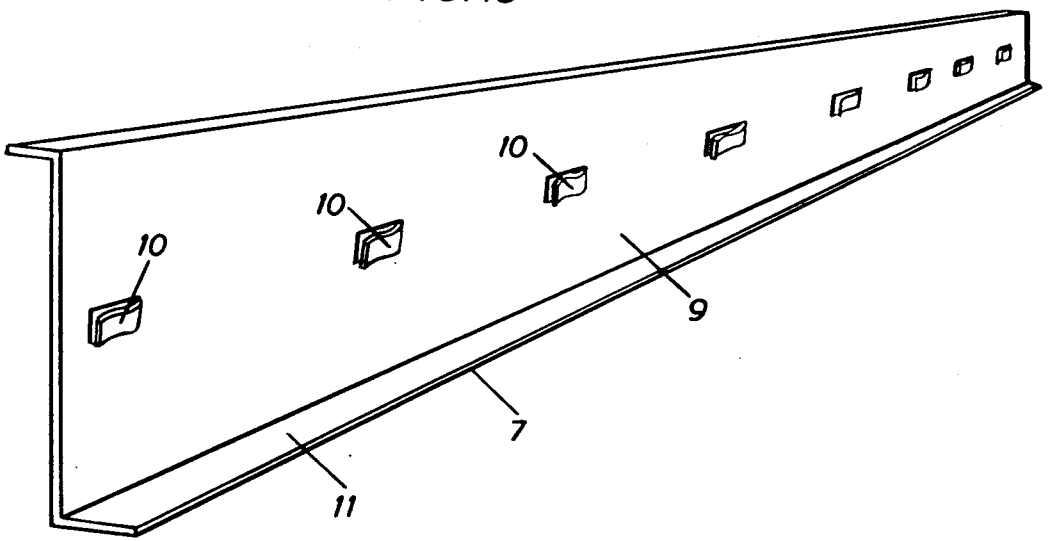
FIG. 10 is a perspective view of a post included in FIG. 9.

FIG. 9 shows an arrangement of structures according to FIG. 5 for the assembly of a partition wall. To this end, the structures closest to the floor are placed in feet 6 which can be of any suitable design but can also be of the design shown in greater detail in FIG. 12. Vertical posts 7, shown in detail in FIG. 10, are also used to stabilize a wall assembled from structures according to the present invention. The feet 6 can also be constructed to support the posts 7 by int.al. being fixedly screwed in the base. Moreover, use is made of cross beams 8, shown in greater detail in FIG. 11, and clamps 5 which are shown in greater detail in FIG. 13 and are manufactured from some suitable material, for example rubber or plastics.

According to FIG. 10, each post 7 has a web 9 with a number of snap-action hooks 10 which are also shown in FIG. 9. The object of the snap-action hooks 10 is that transverse wires 2 should snap into the hooks for fixedly maintaining the post to the structure or sound baffle. Suitably, every second hook 10 can be turned to face outwardly from each respective side of the web 9 so that every second hook 10 can be used for the structure connected to that side of the web. Furthermore, the post 7 is provided with flanges 11 and 12 facing in different directions and serving to orientate and stabilize the structures according to the invention.

Figure 11:
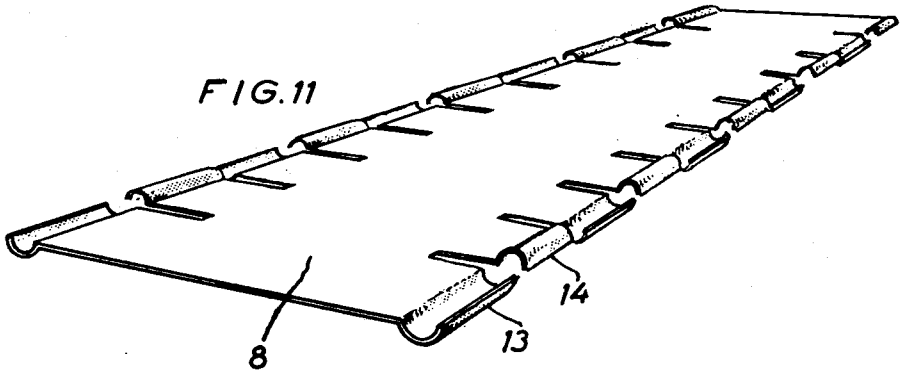
FIG. 11 is a perspective view of a cross beam included in FIG. 9.
Figure 12:
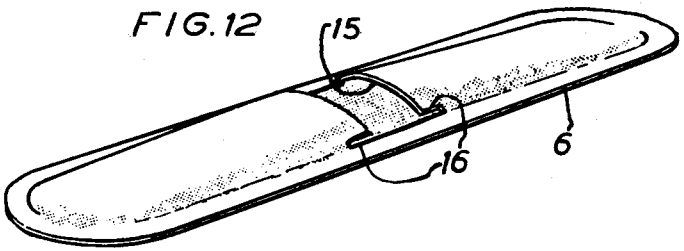
FIG. 12 is a perspective view of a foot included in FIG. 9.

FIG. 11 shows a cross beam or cross piece 8 according to the invention. Each cross beam 8 is provided with a web and with wire clamps 13 and 14 disposed in spaced-apart relationship throughout the length of each longitudinal side edge. The wire clamps 13 and 14 are turned to face in opposite directions for fixedly maintaining a transverse wire 2 between them. The cross beams 8 are placed in the manner shown in FIG. 9. FIG. 12 shows a foot 6 which can be manufactured in different ways from different materials, and in the present case, the foot 6 has a recess 15 with slots 16 for those wires of a structure which are located closest to the floor.

FIG. 13 shows a clamp 5 which is utilized for fixedly holding together two longitudinal wires 1 on different structures or sound baffles according to the present invention. Each clamp 5 has two recesses 17 and 18 which each fit a wire 1 or 2. The clamps 5 should naturally consist of some suitable material, for example, plastics or rubber. Of course, other types of clamps than those shown in FIG. 13 may also conceivably be used.

Figure 14:
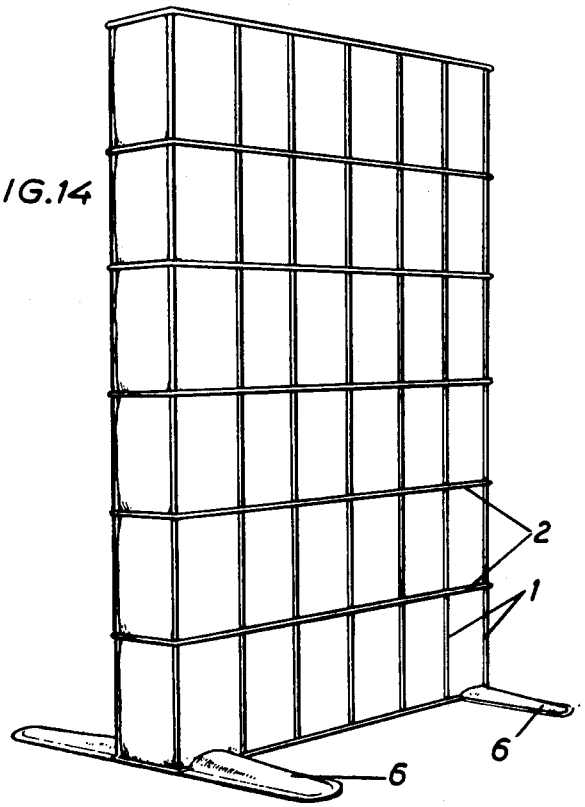
FIG. 14 is a perspective view of a structure provided with feet according to FIG. 12.
Figure 15:
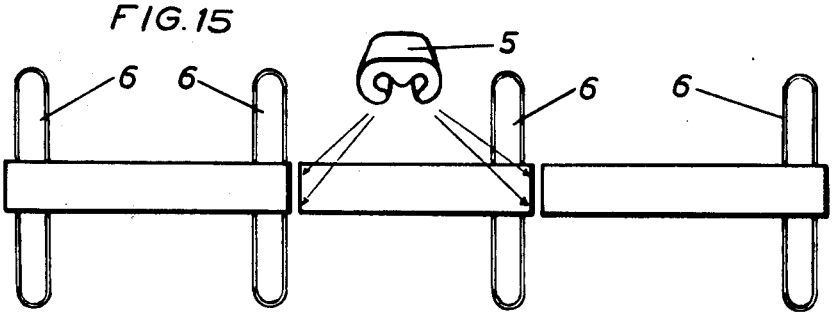
FIG. 15 is a top plan view of a number of structures according to FIG. 14 for the formation of a wall.

In FIG. 14 is shown a structure or sound baffle, mounted in upright position in two feet 6 according to FIG. 12. FIG. 15 is a top plan view of a number of structures according to FIG. 14. It should here be observed that only one of the structures need have two feet 6, while the remaining structures may be provided with a single foot and be connected to the structure having two feet by means of clamps according to FIG. 13.

Figure 16:
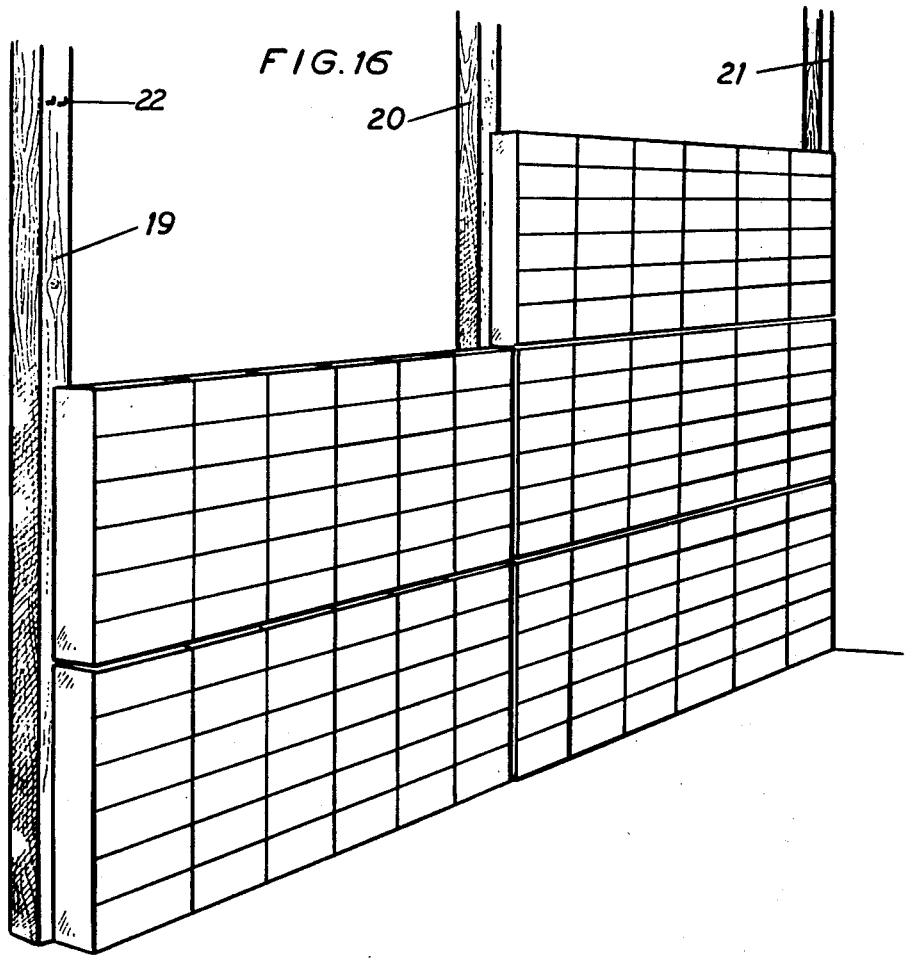
FIG. 16 is a perspective view of structures assembled as a wall-facing on posts.
Figure 17:
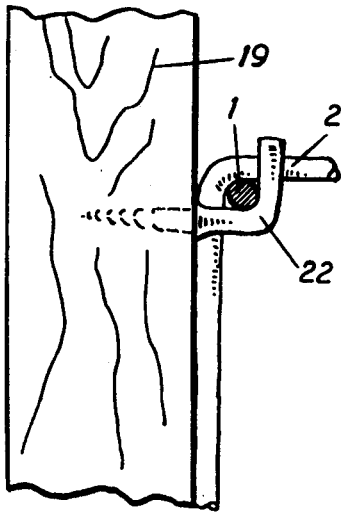
FIG. 17 is a side elevation of a detail for assembly according to FIG. 16.
Figure 18:
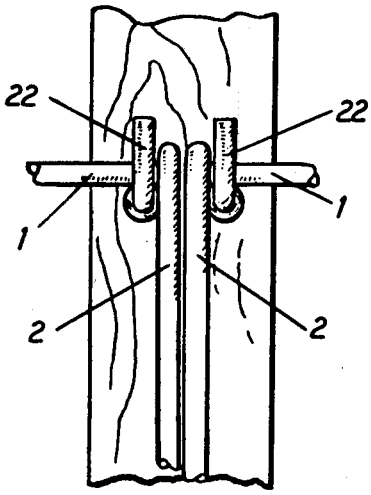
FIG. 18 is a front elevation of details for assembly according to FIG. 16.

FIG. 16 shows structures suspended on posts 19, 20 and 21. The posts 19, 20 and 21 are, in the present case, of wood and the structures are suspended on hooks 22 (shown in more detail in FIGS. 17 and 18). Thus, FIGS. 16–18 illustrate the simple manner in which the structure according to the present invention can be suspended to form a sound-insulating wall.

Figure 19:
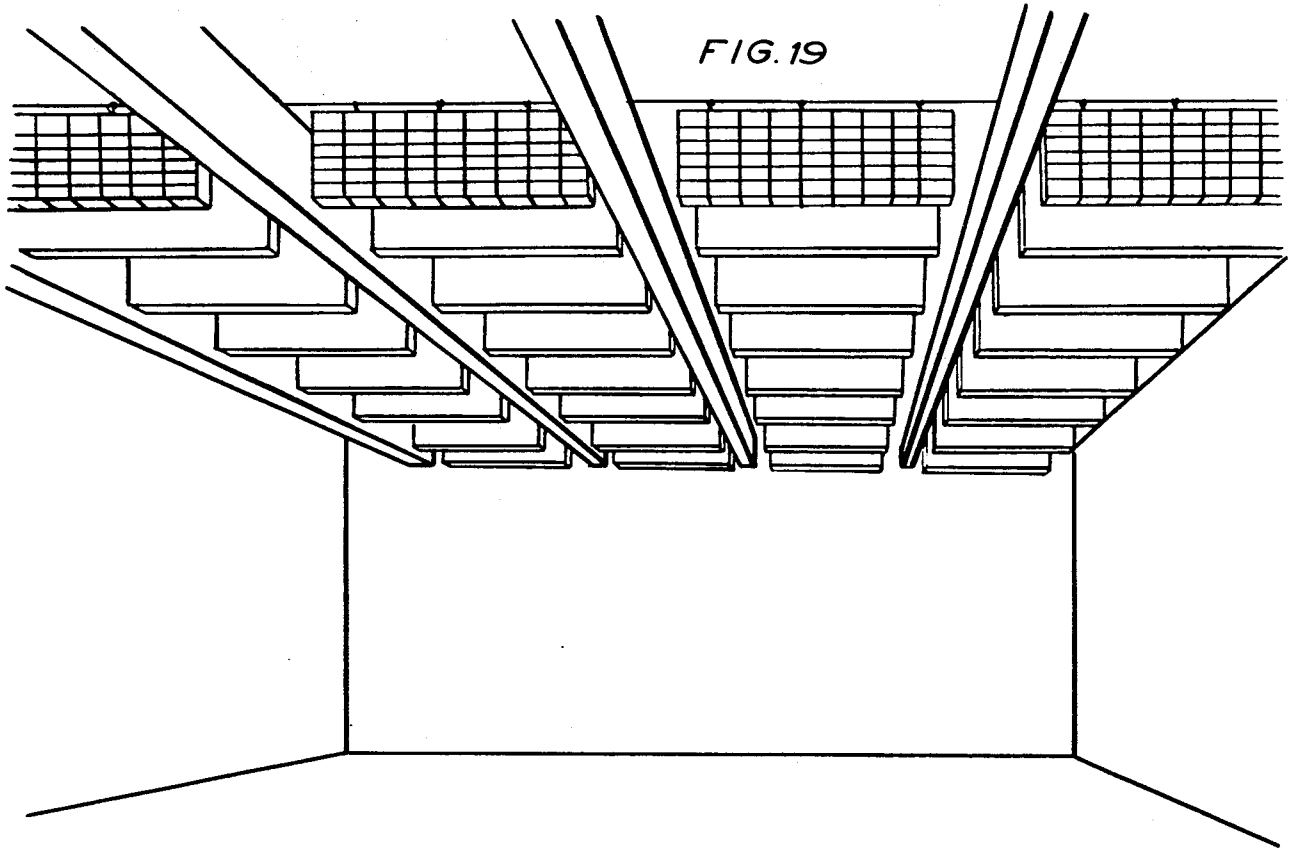
FIG. 19 shows one application of the structures.
Figure 20:
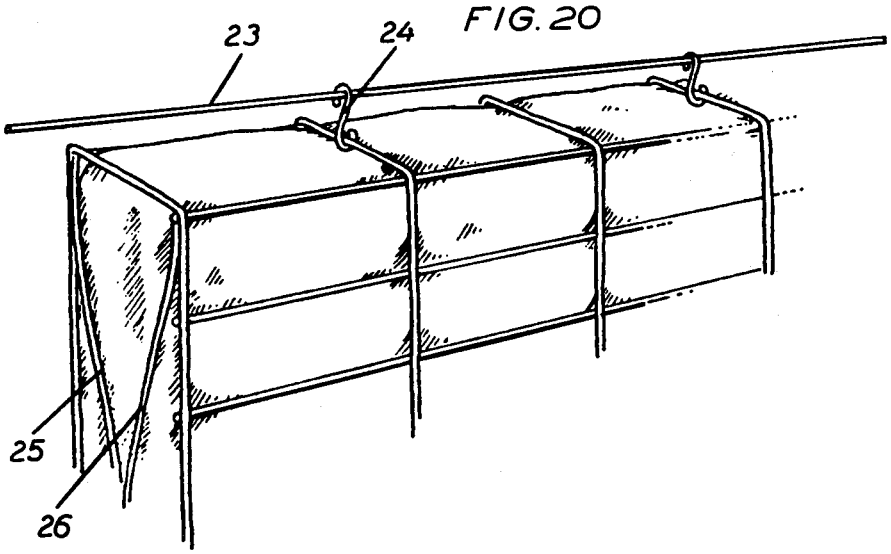
FIG. 20 is a partial perspective view of details for assembly of the structure in accordance with FIG. 19.

FIG. 19 is a perspective view of a ceiling from which a number of structures are suspended in the manner shown in FIG. 20. The structures are suspended on ropes 23 by means of S-hooks 24. Moreover, the structure shown in FIG. 20 is provided with end wires 25 and 26. The object of the end wires 25 and 26 is to protect the sound-insulating material in the envelope formed by the wires 1 and 2.

Figure 22:
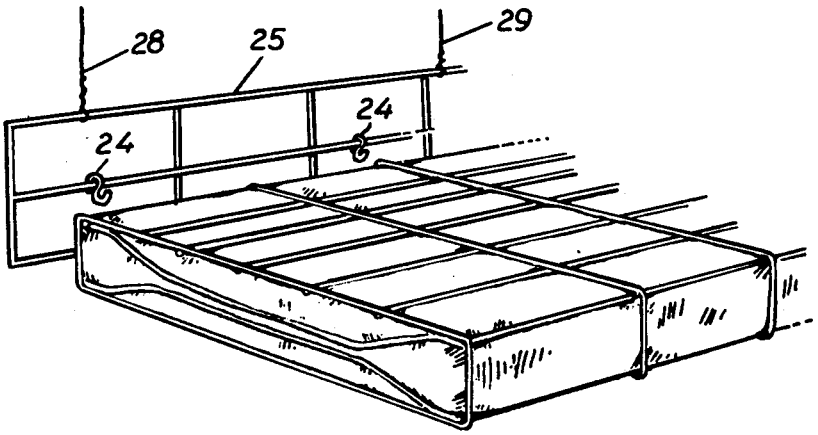
FIG. 22 is a partial perspective view of details for the assembly of structures in accordance with FIG. 21.
Figure 21:
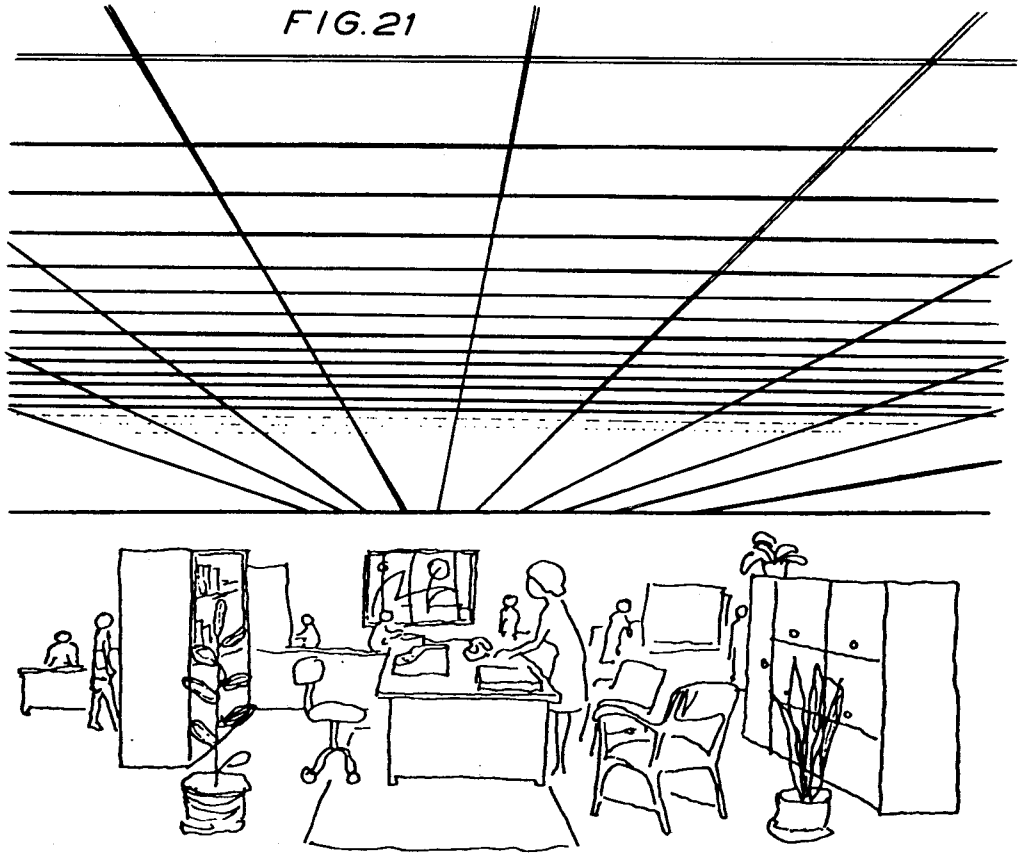
FIG. 21 is a perspective view of a further embodiment of structures.

FIG. 21 shows a further ceiling built from structures according to the present invention in the manner shown in more detail in FIG. 22. The structures are suspended by means of S-hooks 24 in a vertical network 27 which is in turn suspended from the ceiling by means of wires 28 and 29.

FIG. 23 shows a machine booth which is built from structures or sound baffles according to the present invention. Moreover the machine booth is provided with a roof consisting of a structure according to the present invention. With the machine placed as shown in FIG. 24, the booth will provide an excellently soundproofed environment.

Figure 26:
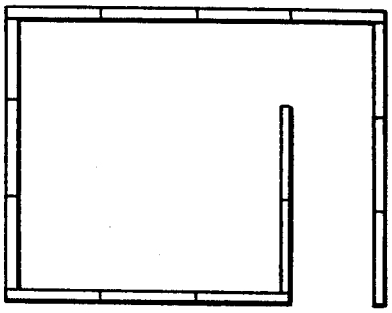
FIG. 26 is a horizontal section through the booth of FIG. 25.
Figure 25:
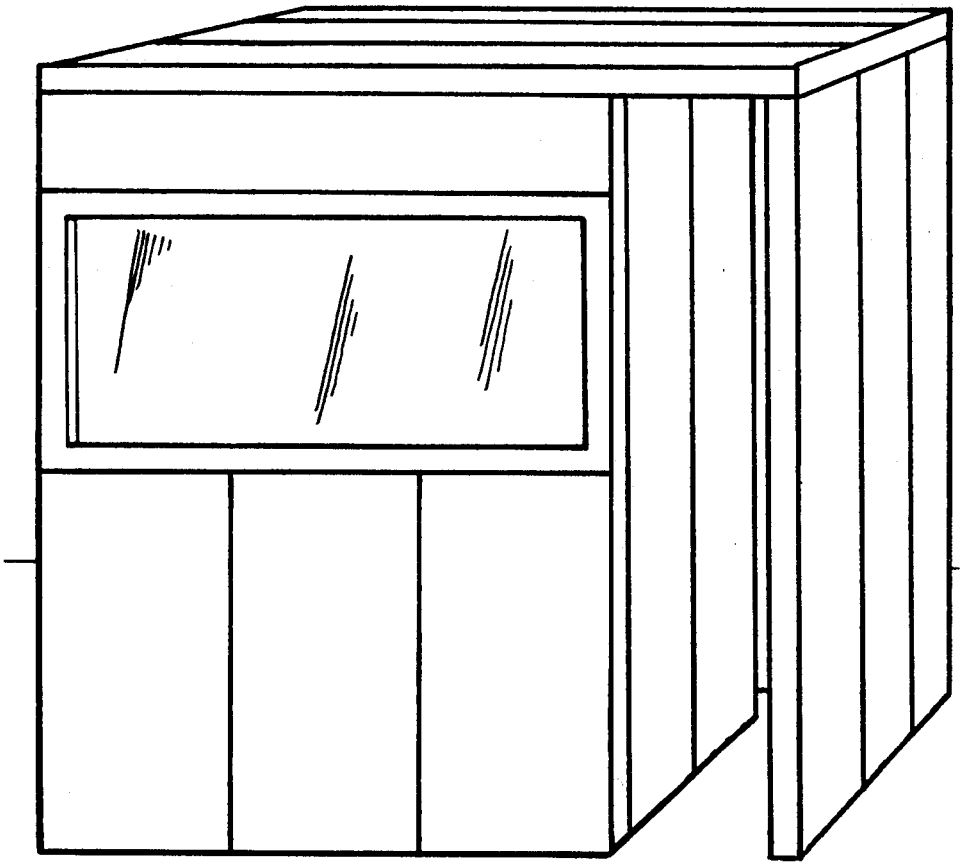
FIG. 25 is a perspective view of a further embodiment of a machine booth built from structures according to the present invention.

FIGS. 25 and 26 show a machine booth, in principle similar to that of FIGS. 23 and 24 but provided with a window for the admission of light (see FIG. 25).

Figure 27:
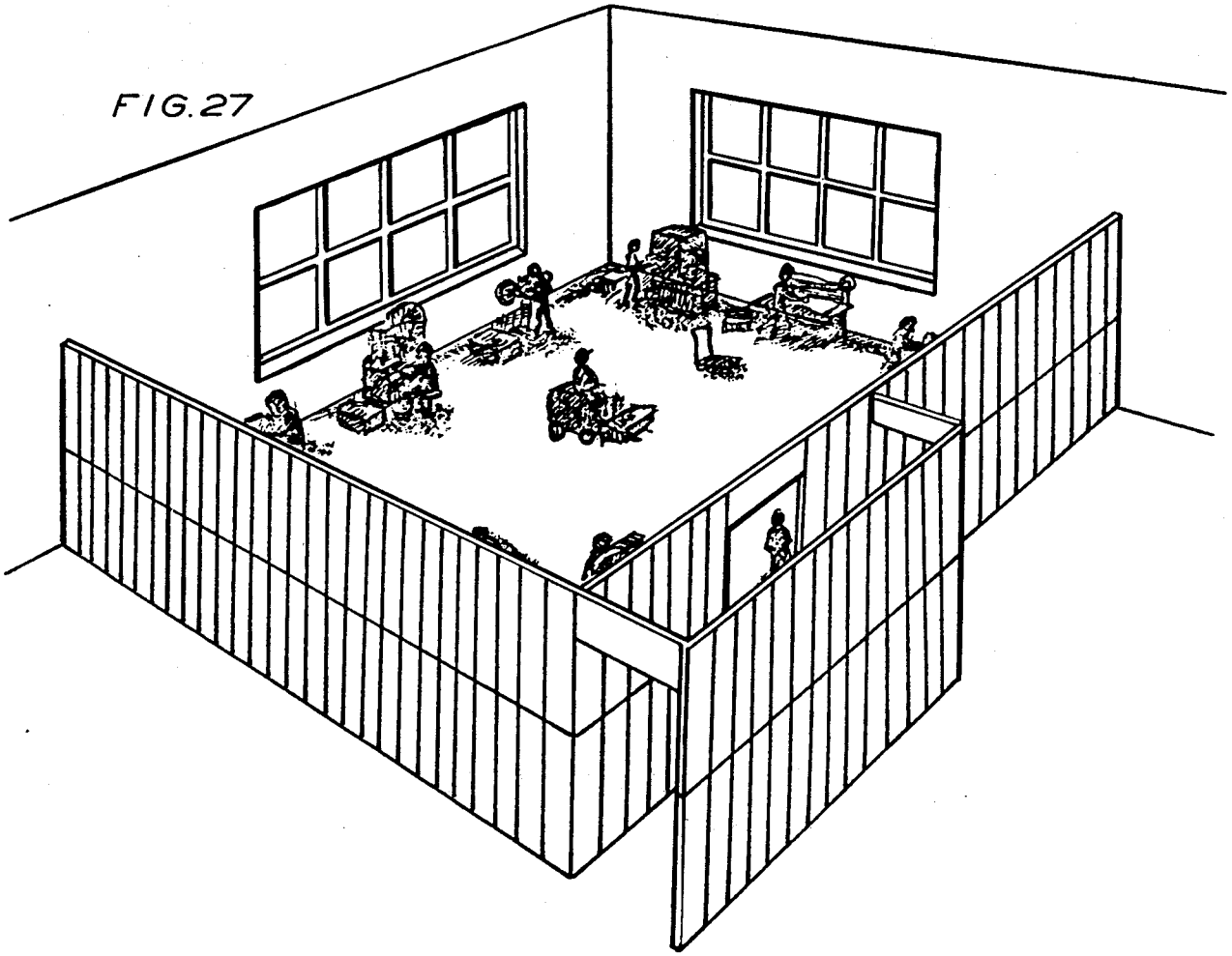
FIG. 27 is a perspective view of a workshop in which a section has been separated from the remainder of the premises by means of partitions built from structures according to the present invention.

FIG. 27 shows how the major part of a workshop can be screened off from the remaining workshop by means of structures according to the present invention. The walls, shown in FIG. 27, comprising structures or sound baffles according to the present invention may be combined in the manner illustrated in FIG. 9 by means of the auxiliary devices shown in FIGS. 9–13, in the same way as the above-exemplified forms of utilization.

Figure 29:
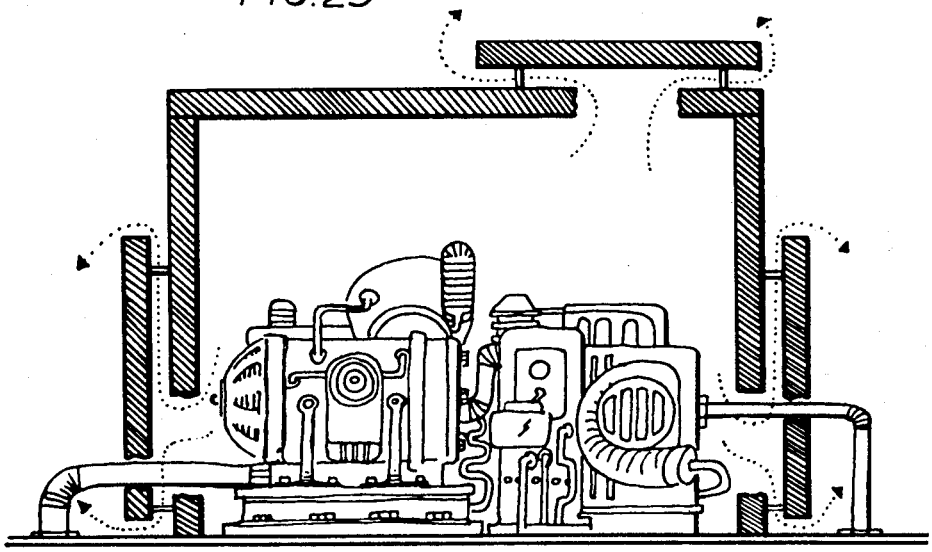
FIG. 29 is a vertical section through the booth of FIG. 28.
Figure 28:
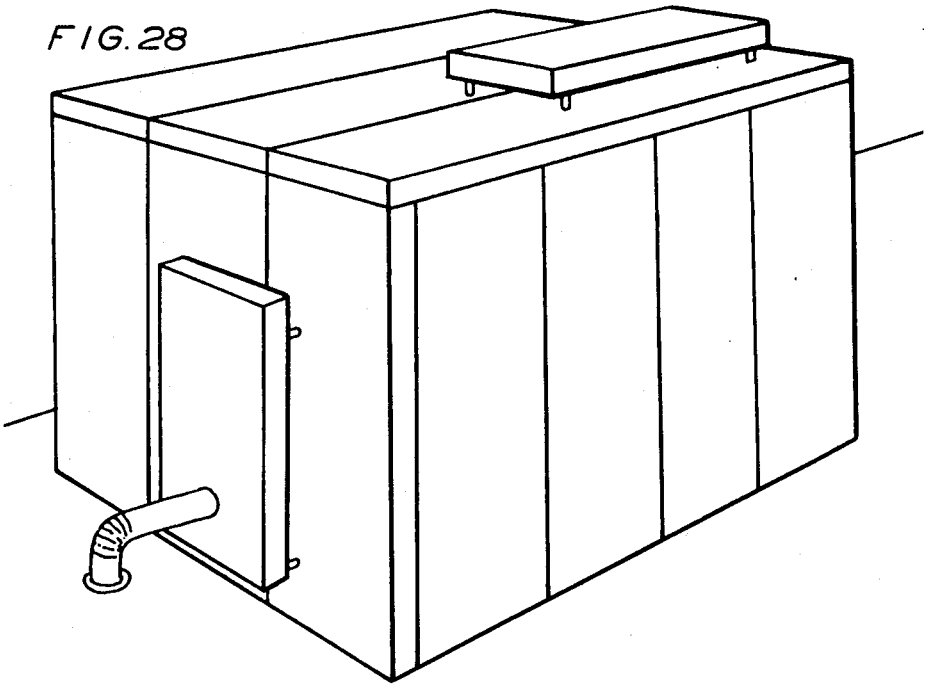
FIG. 28 is a perspective view of a further machine booth built from structures according to the present invention.

A further machine booth is exemplified in FIGS. 28 and 29, the booth being built from structures or sound baffles according to the present invention. Dot-line arrows illustrate, in FIG. 29, how the air circulation can be directed for the almost totally enclosed unit.

Figure 30:
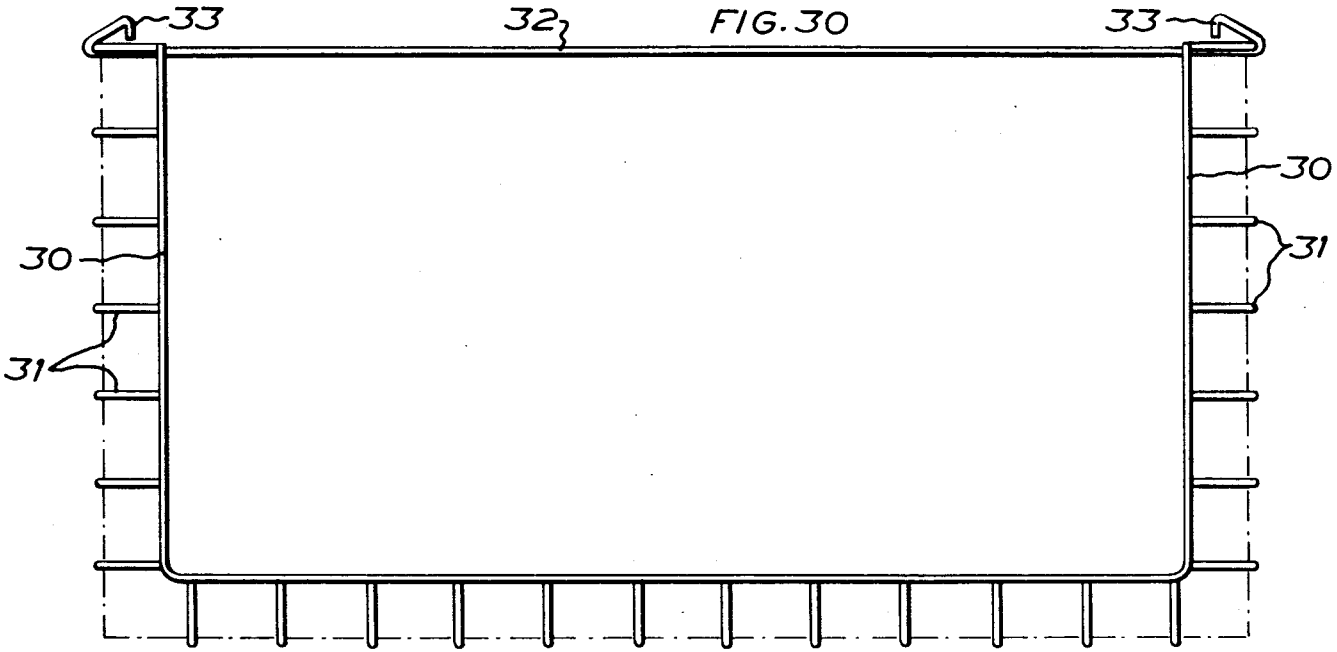
FIG. 30 is a side elevation of a structure according to the present invention.
Figure 31:
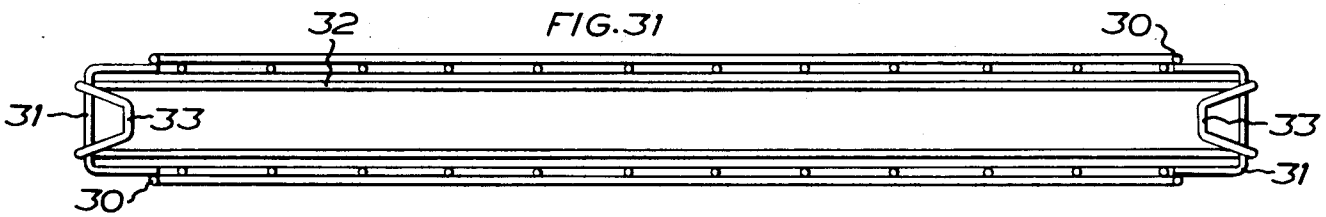
FIG. 31 is a top plan view of the structure of FIG. 30.

A further embodiment of a structure according to the present invention is shown in FIGS. 30 and 31. In this embodiment, the wire structure is in the form of a frame extending along three sides of a sheet of sound-insulating material, the sheet being preferably coated with or wrapped in a material in the form of glass-fibre fabric or the like. The wire frame is manufactured from two longitudinal wires 30 and a number of transverse wires 31. The frame is fixedly held to the sheet by means of a member 32 which extends along the upper side of the structure and has a hook 33 at each end, grasping the outermost transverse wires 31. The hooks 33 can also be utilized for suspending the structure from the ropes or the like when the structure is to serve as a sound baffle in a ceiling.

The major advantage of the embodiment in FIGS. 30 and 31 is that it permits an extremely simple method of manufacture. The frame consisting of the wires 30 and 31 can be quite simply manufactured as a ladder which is bent such that the rungs of the ladder form three sides of a square, whereupon the wires 30 are bent until the frame is substantially given the form shown in FIG. 30. Advantageously, the wires 30 are not bent at a right angle but at a certain obtuse angle. In this manner, a large number of thus bent frames may be nested, thereby greatly facilitating their transport, the sheets which are to be placed in the frames being transported separately. When a structure according to FIGS. 30 and 31 is to be assembled, a sheet is placed in the frame, whereupon a member 32 adapted for fixedly maintaining the frame to the sheet is hooked into the one transverse end wire of the frame and the frame is forced together so that the other hook of the member 32 can grasp the other transervse end wire of the frame, the frame wires 30 springing back into position so that the member 32 is held in place.

Figure 32:
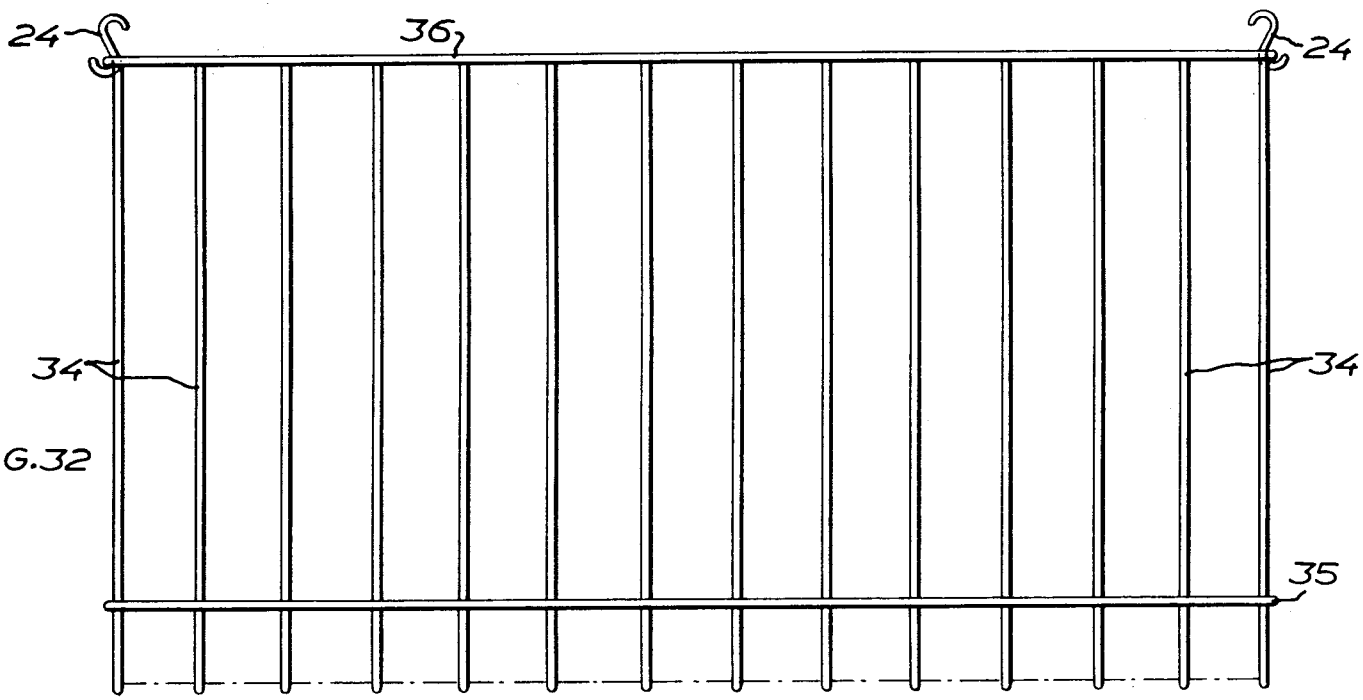
FIG. 32 is a side elevation of a structure according to the present invention.
Figure 33:
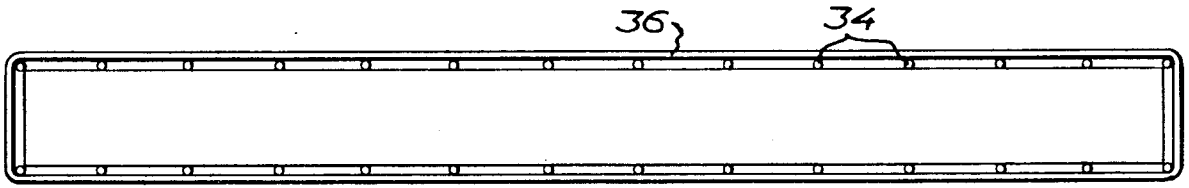
FIG. 33 is a top plan view of the structure of FIG. 32.

FIGS. 32 and 33 illustrate a further embodiment of a structure or sound baffle according to the present invention. This embodiment is intended to be suspended by means of S-hooks 24, and is manufactured from a number of transverse wires 34 which are bent into a U-shape and are held together by means of longitudinal wires 35 and 36 which are welded to the transverse wires 34 at their points of intersection. The insert in this support structure can, as in the earlier cases, consist of one or more compressed sheets of sound-absorbing material which are coated with or wrapped in a suitable material, for example, glass-fibre fabric.

Known elements in ceiling constructions are governed by many different factors, for example, the position and method of suspension, the choice of material in the support structure, the surface and the filler, etc. which restrict the freedom of choice of the designer; and a further object of the present invention is to provide a wire structure which offers freedom of choice for the designer of ceilings and the like, primarily as regards surface structure, heat insulation and sound insulation etc.

Figure 34:
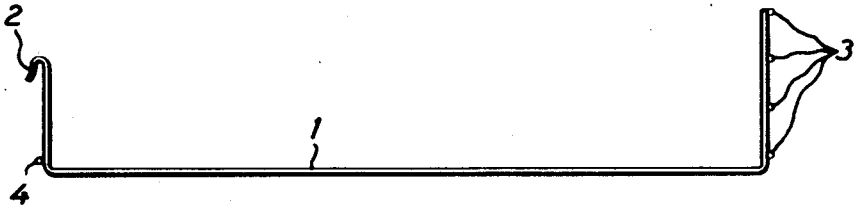
FIG. 34 is an end elevation of a wire structure according to the present invention.
Figure 36:
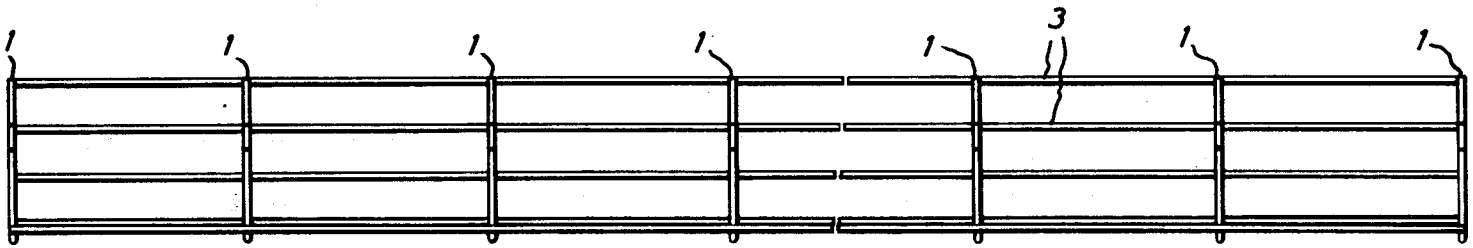
FIG. 36 is a side elevation of the wire structure of FIG. 34.
Figure 35:
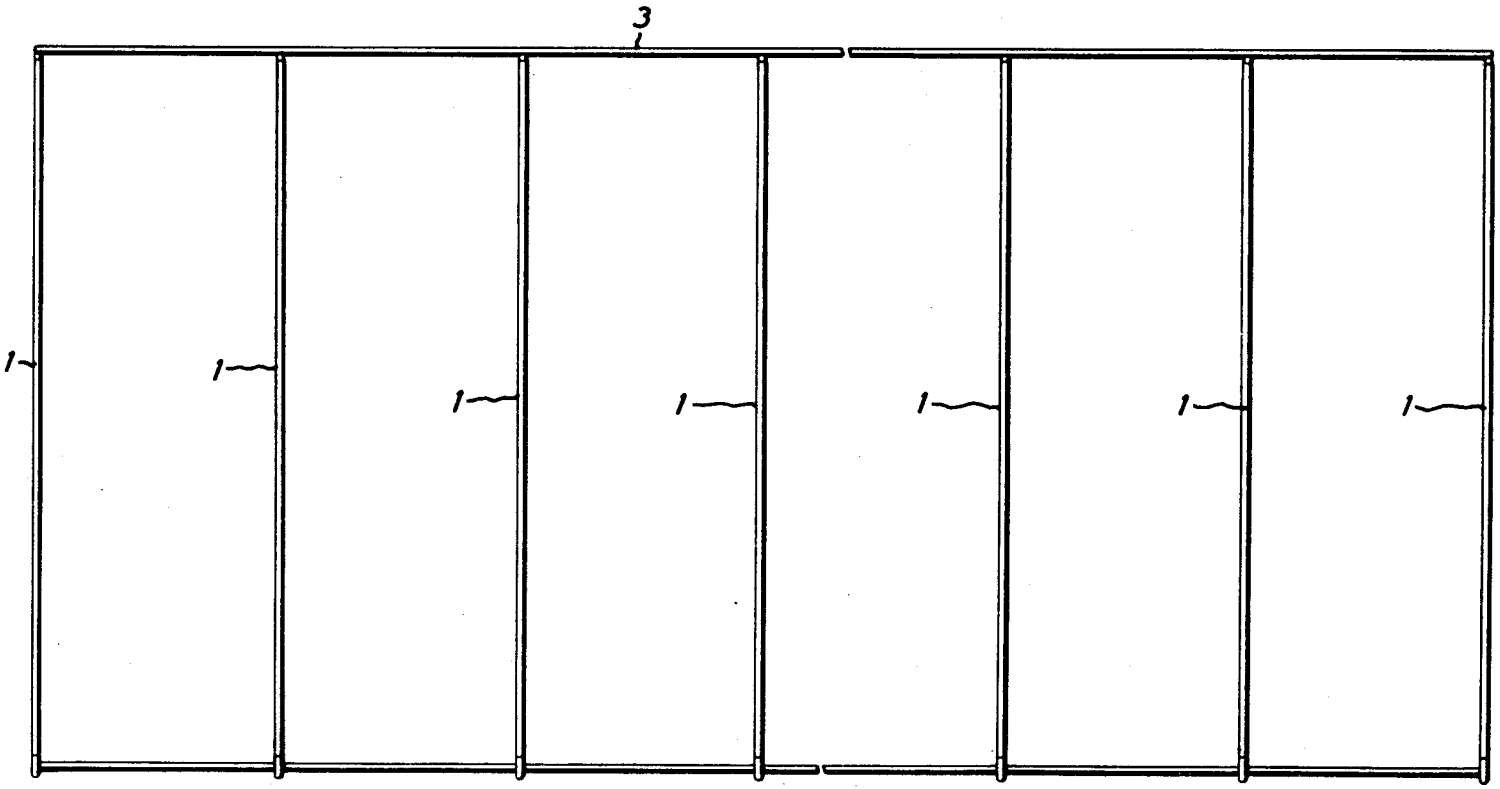
FIG. 35 is a top plan view of the wire structure of FIG. 34.

The wire structure shown in FIGS. 34–36 consists of a number of transverse wires 1, whose one ends are bent at right angles and whose other ends are bent at right angles and so as to form a hook 2. The transverse wires 1 are connected to each other in spaced-apart relationship by means of longitudinal wires. In the present embodiment, four wires 3 are arranged at the one ends which are bent at right angles. At the other ends having the hooks, only a single longitudinal wire 4 is arranged. The wires 1, 3 and 4 are preferably connected to each other by welding.

It is possible to place, for example, a sheet of sound-absorbing material in the space formed in the wire structure according to the present invention. This sheet can possibly be coated with or wrapped in a suitably coloured or neutral colour fabric. The wires can be of the same colour as the fabric, or be of some other colour.

Apart from a suitable considerable manufacturing advantage, the structure according to the present invention displays a further advantage from the point of view of transport, since a number of structures can be nested. Moreover, assembly is greatly simplified, since the hooks 2 can cooperate with any longitudinal wires 3 of an adjacent structure. Further, there is a completely unlimited choice of material for the structure itself.

I claim:

1. A sound absorbing rectangular parallelepiped structure having 12 edges and being comprised of a wire lattice having sound absorbing material housed therein, said lattice having longitudinal wires and transverse wires which cross over each other at a plurality of locations, the longitudinal and transverse wires being fixedly interconnected to each other at at least a majority of said plurality of locations causing the structure to be inherently stable, a wire being located at each of said edges of the structure and the spacing between adjacent wires in at least one direction of said lattice being the same as the thickness of the structure.

2. A sound absorbing structure according to claim 1, characterized in that the sound-absorbing material is enclosed in some suitable coating or wrapping material.

3. A sound absorbing structure according to claim 1, characterized in that both the wire structure and the sound-absorbing material are enclosed in some suitable coating or wrapping material.

4. A sound absorbing structureaccording to claim 2, characterized in that the coating material is glass-fibre fabric.

* * * * *